US007124585B2

(12) United States Patent
Kim et al.

(10) Patent No.: US 7,124,585 B2
(45) Date of Patent: Oct. 24, 2006

(54) SCROLL-TYPE EXPANDER HAVING HEATING STRUCTURE AND SCROLL-TYPE HEAT EXCHANGE SYSTEM EMPLOYING THE EXPANDER

(75) Inventors: Young-Min Kim, Daejeon (KR); Dong-Gil Shin, Daejeon (KR); Jang-Hee Lee, Daejeon (KR)

(73) Assignee: Korea Institute of Machinery & Materials, Daejeon (KR)

( * ) Notice: Subject to any disclaimer, the term of this patent is extended or adjusted under 35 U.S.C. 154(b) by 168 days.

(21) Appl. No.: 10/504,805

(22) PCT Filed: Feb. 14, 2003

(86) PCT No.: PCT/KR03/00321

§ 371 (c)(1),
(2), (4) Date: Aug. 13, 2004

(87) PCT Pub. No.: WO03/069130

PCT Pub. Date: Aug. 21, 2003

(65) Prior Publication Data

US 2005/0172622 A1 Aug. 11, 2005

(30) Foreign Application Priority Data

| | | |
|---|---|---|
| Feb. 15, 2002 | (KR) | 10-2002-0008270 |
| Feb. 15, 2002 | (KR) | 10-2002-0008271 |
| Nov. 6, 2002 | (KR) | 10-2002-0068455 |
| Nov. 6, 2002 | (KR) | 10-2002-0068456 |

(51) Int. Cl.

| | |
|---|---|
| ***F01K 7/02*** | (2006.01) |
| ***F01K 1/00*** | (2006.01) |
| ***F01K 7/22*** | (2006.01) |
| ***F01K 25/10*** | (2006.01) |
| ***F01C 1/04*** | (2006.01) |
| ***F01C 11/00*** | (2006.01) |
| ***F01C 21/00*** | (2006.01) |
| ***F04C 18/04*** | (2006.01) |
| ***F04C 23/00*** | (2006.01) |

(52) U.S. Cl. ..... 60/643; 60/670; 60/679; 418/55.1; 418/55.2

(58) Field of Classification Search ..... 60/643, 60/670, 679; 418/55.1, 55.2
See application file for complete search history.

(56) References Cited

U.S. PATENT DOCUMENTS 3,986,799 A * 10/1976 McCullough ..... 418/55.2

(Continued)

FOREIGN PATENT DOCUMENTS

JP 57-303 A 1/1982

*Primary Examiner*—Sheldon J Richter
(74) *Attorney, Agent, or Firm*—Fulbright & Jaworski L.L.P.

(57) ABSTRACT

The present invention provides a scroll-type expander that simultaneously performs expansion and re-heating such that efficient expansion is realized and there is no reduction in efficiency caused by pressure loss occurring during the supply of an working fluid to the scroll-type expander, and that minimizes a difference in temperature between a stationary scroll member and a rotating scroll member, as well as a temperature distribution of a scroll wrap. The present invention also relates to a heat exchange system that uses a scroll-type expander to replace pistons in a conventional reciprocating Stirling engine or refrigerator with a pair of scroll-type compressor and expander such that the heat exchange system may be used as a Stirling engine or refrigerator. The present invention also provides a steam engine, in which a steam turbine in the conventional steam engine (Rankine system) is replaced with a scroll-type expander such that the steam cycle has both a re-heating cycle and a regeneration cycle.

19 Claims, 11 Drawing Sheets

U.S. PATENT DOCUMENTS 4,192,152 A 3/1980 Armstrong et al.
4,553,913 A * 11/1985 Morishita et al. ..... 418/88
4,773,144 A 9/1988 Youtie
4,990,071 A * 2/1991 Sugimoto ..... 418/55.2
5,228,309 A 7/1993 McCullough
5,340,292 A * 8/1994 Steele ..... 418/55.1
5,842,843 A * 12/1998 Haga ..... 418/55.2
5,961,297 A * 10/1999 Haga et al. ..... 418/55.1
6,123,529 A * 9/2000 Kawano et al. ..... 418/55.1
6,186,755 B1 * 2/2001 Haga ..... 418/55.1
6,758,659 B1 * 7/2004 Ni ..... 418/55.2
6,922,999 B1 * 8/2005 Kimura et al. ..... 60/643

* cited by examiner

SCROLL-TYPE EXPANDER HAVING HEATING STRUCTURE AND SCROLL-TYPE HEAT EXCHANGE SYSTEM EMPLOYING THE EXPANDER

BACKGROUND OF THE INVENTION (a) Field of the Invention

The present invention relates to a scroll-type expander and a scroll-type compressor, and more particularly, to a scroll-type expander and a scroll-type compressor that include a stationary scroll member and a rotating scroll member to continuously perform expansion and compression of an working fluid. The present invention also relates to a scroll-type heat exchange system that includes a scroll-type expander and scroll-type compressor for use as a Stirling engine or refrigerator.

(b) Description of the Related Art

Scroll device offers many advantages including high efficiency, low noise, low vibration, small size, and light weight. Scroll devices are widely used as a result of these advantages scroll-type compressor In more detail, with reference to FIG. 1, a stationary scroll member 30 of involute form and a rotating scroll member 40 are provided at a 180° phase difference. As a result, a series of crescent-shaped pockets are formed within the scroll-type compressor. Gas flows into the scroll-type compressor through an intake passage located at a circumference of the stationary scroll member 30, and the crescent-shaped pockets move toward a center of the two scrolls 30 and 40 by the orbiting action of the rotating scroll member 40. A volume of the pockets is reduced through this operation such that the gas is compressed. The gas is then discharged through a discharge port formed in a center of the stationary scroll member 30. During each orbit, several crescent-shaped pockets are compressed simultaneously, so operation is continuous.

In the scroll-type expander, the scroll-type compressor is simply operated in reverse such that a gas is expanded. That is, a high pressure gas is provided to the center of the stationary scroll member 30 such that the orbiting scroll member 40 is displaced to realize expansion of the gas, which is then discharged through the circumferential opening of the stationary scroll member 30. Motive power is generated by the orbiting motion of the rotating scroll member 40.

Compared to other types of compressors, the scroll-type compressor requires less parts, is small and lightweight, and provides other advantages such as high efficiency, low vibration, and low noise. As a result, the scroll-type compressor is widely used as a refrigerant compressor and air compressor. The scroll-type expander, on the other hand, has not experienced widespread use.

As a conventional expander, U.S. Pat. No. 4,192,152 discloses a scroll apparatus with peripheral drive that can be used as a compressor and an expander, and a heat engine that combines a compressor, a burner, and an expander, and also discloses a Brayton cycle-type cooling cycle that combines a compressor and an expander. Also, EP Patent No. 0846843A1 discloses a heat engine that combines a compressor, a regenerator, a burner, and an expander. In addition, there has also been recently disclosed in the United States a steam cycle (Rankine system) that uses a scroll-type expander in place of a steam engine.

However, in patents and research related to scroll-type expanders disclosed up to now, high pressure gas or steam is supplied to a center area of the scroll-type expander to generate motive power as in conventional turbines. As a result, efficiency is reduced by pressure loss when supplying the gas or steam such that while compression efficiency reaches up to 90%, expansion efficiency is only about 60~70%. Further, in the conventional scroll-type expander, a difference in temperatures between the stationary scroll member and the orbiting scroll member develops, and a temperature gradient occurs within the same scroll wrap itself. These factors result in a reduction in efficiency by the generated friction, leakage, and increased vibration.

A Stirling engine is an external combustion engine that includes a plurality of heat exchangers that heat and cool the enclosed charge gas. Most Stirling engines are external combustion engines of reciprocating piston types.

Because the Stirling engine is an external combustion engine, it may use various heat sources such as liquid fuel, gas fuel, solid fuel, industrial waste energy, solar energy, and LNG. The Stirling engine provides high efficiency due to a regenerator mounted between a heater and a cooler. Also, because the Stirling engine does not include valves and realizes smooth pressure changes, a low level of noise and vibration are generated compared to the internal combustion engine. Also, since continuous combustion occurs in the Stirling engine, combustion control is easy and the exhaust gas is relatively clean, thereby making the Stirling engine a possible candidate for widespread use in the future.

With reference to FIG. 8, which shows a basic structure of a conventional Stirling engine 200, an expansion piston 201 and a compression piston 203 are coupled to a common crankshaft with about 90° phase difference. An expansion space 205 and a compression space 207 are formed and connected to a regenerator 209 that is filled with thermal energy storage material having gas permeability. With this configuration, since it is difficult to realize sufficient heating and cooling of the working gas by a cylinder wall of a small heat transfer area, a cooler 212 and a heater 214 are provided to opposite sides of the regenerator 209 as shown in FIG. 9.

To simplify the mechanical structure and reduce vibration of the reciprocating-I Stirling engine, U.S. Pat. No. 6,109,040 discloses a configuration that uses two rotary Wankel rotors and provides for a phase difference as in the reciprocating Stirling engine such that compression and expansion are alternatingly realized.

Since two pistons reciprocate in cylinders synchronously but out of phase so that the working gas shuttles cyclically from one space to the other as the volume and pressure vary from maximum to minimum and go through the four processes of the Stirling cycle in order, the working fluid undergoes pressure loss due to the oscillating flow through the regenerator positioned between the compression cylinder and the expansion cylinder such that an increase in rotational speed results in the reduction in torque. In addition, because it is difficult to realize sufficient heating and cooling of the working gas by a cylinder wall of a small heat transfer area, the cooler 212 and the heater 214 are provided to opposite sides of the regenerator 209 as shown in FIG. 9, and it is necessary to use a gas having a low molecular weight such as hydrogen or helium as the working gas. However, in the case where a gas of a low molecular weight is used as the working gas, leakage easily occurs such that it is extremely important to use a high performance gas seal.

With reference to FIGS. 10 and 11, an ideal Stirling cycle includes isothermal compression (I–II) while in a low temperature compression section 223, constant volume heating (II–III) while passing a regenerator 221, isothermal expansion (III–IV) while in a high temperature expansion section 224, and constant volume heat rejection (IV–I) while passing the regenerator 221. However, the actual cycle is more like that shown in FIG. 12, which is significantly less efficient than the ideal case. The reasons for such a difference between an ideal Stirling cycle and the actual cycle, and the difficulties in realizing the ideal cycle, will be described as follows.

First, to realize the isothermal compression (I–II) and isothermal expansion (III–IV) sections of the ideal Stirling cycle, fast heat transfer must occur through the inside surface of the cylinder walls. However, even if a sufficient number of heat transfer pins are mounted outside the cylinder, since the area of the inside surface of the cylinder walls making contact with the working gas is limited, it is difficult for the working gas to be heated or cooled isothermally. This becomes increasingly problematic if the engine is made faster and to larger sizes, in which case the processes inside the cylinder becomes more adiabatic (no heat transfer) than isothermal (infinite heat transfer).

It is for this reason that the additional heater 214 and cooler 212 are mounted to opposite ends of the regenerator 209 to ensure effective heating and cooling of the working gas. Although the heater 214 and cooler 212 allow for the effective heating and cooling of the working gas to increase the specific power, the provision of such heat exchangers imposes some penalties as follows.

In particular, the increase in dead volume, which includes the heater 214, the regenerator 209, and the cooler 212, acts to decrease output. Further, it results in anomalies in which the expanded working gas picks up heat from the heater 214 before deposing its heat in the regenerator 209 and in which the compressed gas has to pass through the cooler 212 before going back through regenerator 209 to pick up heat. As a result, the flow resistance is increased and thermal efficiency is reduced. Further, the thermal stress to the structural parts increases such that care must be given in selecting the materials for the parts and other limitations are given to manufacture of the device.

In the ideal Stirling cycle as shown in FIG. 10, since the motions of the pistons 225 and 227 are discontinuous, only compression occurs in the low temperature compression section 223 and only expansion occurs in the high temperature expansion section 224. However, in an actual reciprocating Stirling engine shown in FIG. 9, the compression piston 203 and the expansion piston 201 are linked to move together such that during compression by the compression piston 203 of the low temperature section, compression occurs slightly also by operation of the expansion piston 201 of the high temperature section. Likewise, during expansion by the expansion piston 201 of the high temperature section, expansion occurs slightly also by operation of the compression piston 203 of the low temperature section. This is another main reason why the efficiency of the actual Stirling engine is significantly less than that of the ideal Carnot engine.

The steam cycle includes four successive changes. These include heating of the working fluid, evaporation, expansion, and condensation. The Rankine cycle is the ideal cyclical sequence of changes of pressure and temperature of the working I fluid, and is used as a standard for rating the performance of steam power plants.

With reference to FIG. 13, a steam engine 300 typically includes a water supply pump 303 (adiabatic compression), a boiler 305 and a re-heater 307 (isobaric heating), turbines 309 and 312 (adiabatic expansion), and a condenser 301 (isobaric heat radiation). A steam turbine is most commonly used by a power output device in the steam engine that is used as an external combustion engine. The steam turbine converts heat energy into kinetic energy such that high speed steam strikes a turbine to obtain a rotational force of the same.

As a way to improve efficiency in the steam cycle, referring again to FIG. 13, the re-heater 307 is used and the steam in the expansion stage is extracted to the outside of the turbine 309 before being saturated, and is made into superheated steam after being heated in the re-heater 307. The steam is again directed to the turbine 312 to use a re-heating cycle that expands the steam until reaching the output pressure. Thermal efficiency may be improved by increasing the number of re-heating stages. However, if the number of re-heating stages is increased, the fluid needs to be circulated between the boiler 305 and turbines 309 and 312, both the overall size of the assembly and equipment costs are increased, and operational control becomes complicated. Accordingly, re-heating is typically performed one or two times, which places a limitation on the efficiency of the steam cycle.

In the reciprocating piston or Wankel rotary device, which are conventional positive displacement expanders used as external combustion engines in place of the steam turbines 309 and 312, since the area of heat transfer through the cylinder walls decreases compared to volume as capacity is increased, efficiency reduces in proportion to increases in size of the device.

SUMMARY OF THE INVENTION

The present invention provides a scroll-type expander that simultaneously performs expansion and re-heating such that highly efficient expansion that approximates isothermal expansion is realized and such that there is no reduction in efficiency caused by pressure loss occurring during the supply of an working fluid such as gas or steam to a center area of the scroll-type expander, and that minimizes a difference in temperature between a stationary scroll member and a orbiting scroll member, as well as a temperature distribution of a scroll wrap.

The present invention also relates to a heat exchange system that uses a scroll-type expander to replace pistons in a conventional reciprocating Stirling engine or refrigerator with a pair of scroll-type compressor and expander such that the heat exchange system may be used as a Stirling engine or refrigerator.

The present invention also provides a steam engine, in which a steam turbine in the conventional steam engine (Rankine system) is replaced with a scroll-type expander such that the steam cycle has both a re-heating cycle and a regeneration cycle.

In one embodiment, the present invention provides a scroll-type expander including a sealed housing having a heating surface to an outside area, and including at least one of each of an inflow opening and an exhaust opening at both a center area and a circumferential area; stationary scroll members fixed within the housing and extending from the center area of the housing outwardly in a spiral shape; orbiting scroll members meshed with the stationary scroll members within the housing and extending from the center area of the housing outwardly in a spiral shape, the orbiting scroll members orbiting along a predetermined orbiting radius to continuously expand working fluid entering the housing; heating chambers provided to an outer circumference of the housing and which supply heat when working fluid is expanded by the motion of the orbiting scroll members; and drive shafts connected to the orbiting scroll members to drive the scroll members.

The scroll-type expander may further include a preheating pipe connected to the working fluid inflow opening of the center area of the housing and extending into the heating chambers to pass through the heating chambers so that the working fluid entering the heating chambers may absorb heat, and a plurality of heating pins formed to the external heating surface of the housing that is located within the heating chambers.

A power transmission shaft may be connected to an outside of one of the drive shafts to enable the transmission of power to outside the scroll-type expander.

The scroll-type expander may further include heat pipes as a heat transfer assembly connected to the heating chambers and able to transmit large amounts of heat by the low temperature difference as a result of latent heat.

The steam engine includes a scroll-type expander as described above; a heat exchanger through which high temperature working fluid expanded in the scroll-type expander and exhausted from the scroll-type expander passes; a condenser for condensing the working fluid passing through the heat exchanger; a storage tank for storing the working fluid passing through the condenser; and a pump for pressurizing the working fluid passing through the storage tank. The working fluid pressurized in the pump is circulated by again passing through the heat exchanger to receive heat from high temperature heat source.

With the scroll-type expander of the present invention, heating, expansion, and re-heating take place in the expander itself such that a compact configuration is realized and isothermal expansion that approaches an infinite stages re-heating cycle is realized.

The scroll heat exchange system includes a scroll-type compressor including a sealed housing having a heat radiation surface and having at least one of each of the working fluid inflow opening and an exhaust opening at both a center area and a circumferential area, a stationary scroll member fixed within the housing and extending from the center area of the housing outwardly in a spiral shape, and an orbiting scroll member meshed with the stationary scroll member within the housing and extending from the center area of the housing outwardly in a spiral shape, the orbiting scroll members orbiting along a predetermined orbiting radius to continuously compress working fluid entering the housing; a scroll-type expander including a sealed housing having a heating surface and having at least one of each of an working fluid inflow opening and an exhaust opening at both a center area and a circumferential area, a stationary scroll member fixed within the housing and extending from the center area of the housing outwardly in a spiral shape, and an orbiting scroll member meshed with the stationary scroll member within the housing and extending from the center area of the housing outwardly in a spiral shape, the orbiting scroll members orbiting along a predetermined orbiting-radius to continuously expand working fluid entering the housing; a driver connected to each of the orbiting scroll members of the scroll-type compressor and the scroll-type expander to drive the orbiting scroll members; a first connector interconnecting the working fluid exhaust and inflow openings at the outer areas of the scroll-type compressor and the scroll-type expander; a second connector interconnecting the working fluid exhaust and inflow openings at the center areas of the scroll-type compressor and the scroll-type expander; a regenerator through which the first and second connectors pass in a state adjacent to one another to realize heat exchange between the working fluid passing through the first and second connectors; and working fluid compressed in the scroll-type compressor, exhausted through the exhaust opening at the center area of the scroll-type compressor, passed through the regenerator via the second connector, then supplied through the inflow opening at the center area of the scroll-type expander, after which the working fluid undergoes expansion in the scroll-type expander, is exhausted through the exhaust opening at the outer area of the scroll-type expander, passed through the regenerator via the first connector, and supplied through the inflow opening at the outer area of the scroll-type compressor to thereby realize circulation of the working fluid through the heat exchange system.

The scroll heat exchange system may further include a cooling section formed around an outer circumference of the housing that surrounds the scroll-type compressor such that heat generated when working fluid is compressed is expelled outwardly, and a heating section formed around an outer circumference of the housing that surrounds the scroll-type expander such that heat is supplied during expansion of working fluid.

The scroll heat exchange system may further include a cooler connected to the working fluid inflow opening provided to the outer area of the scroll-type compressor and acting to cool the working fluid that is supplied to the scroll-type compressor after passing through the regenerator, and a heater connected to the working fluid exhaust opening provided to the center area of the scroll-type expander and acting to heat the working fluid that is supplied to the scroll-type expander after passing through the regenerator.

The scroll heat exchange system may further include a bypass line communicating an area between a center compression area of a predetermined distance from the center area of the housing and the connector connected to the working fluid exhaust opening of the center area, and a control valve mounted on the bypass line to control the amount of fluid that is bypassed to vary compression amounts.

The scroll heat exchange system may operate as an engine when a heat of a temperature higher than a temperature of the scroll-type compressor is supplied to the scroll-type expander, and power is output from the drivers connected to the scroll-type expander and the scroll-type compressor. Also, the scroll heat exchange system may operate as a refrigerator when power is input to the drivers connected to the scroll-type expander and the scroll-type compressor, and a heat of a temperature lower than a temperature of the scroll-type compressor is absorbed in the scroll-type expander.

In the scroll heat exchange system of the present invention, the mechanical structure is simple, and compression and expansion are continuously performed such that there is almost no variation in torque and a flow direction of the operational fluid is unchanged. As a result, flow lines and regenerator structure may be realized such that flow resistance is small.

In addition, since the heat transfer area making contact with the working fluid in the compressor and expander is extremely large, highly efficient isothermal compression and expansion that approaches the ideal Stirling cycle is possible, and a heater and cooler may be made small or removed altogether such that dead volume is reduced to improve output. Finally, overall manufacturing costs are reduced by minimizing or removing the need for the heater.

In the scroll heat exchange system of the present invention, since the working fluid flow is in one direction, the working fluid heated in the heater is not re-heated following expansion, and the working fluid cooled in the cooler is not re-cooled following compression such that heat loss, flow resistance, thermal stress, etc. caused by anomalies in the cycle may be reduced.

In addition, since low temperature compression and high temperature expansion are realized as fully separated processes, high efficiency that approaches an ideal cycle may be obtained. Also, compression ratio control by the bypass line in the compressor is easy such that effective engine control is possible.

Finally, in the scroll heat exchange system of the present invention, since continuous, steady state driving is possible, there are almost no periodic temperature and pressure variations in the structural elements such that limitations on the selection of materials for and manufacture of the structural elements are significantly reduced, and low noise, low vibration, small size, and light weight may be realized as a result.

DETAILED DESCRIPTION OF THE PREFERRED EMBODIMENTS

Preferred embodiments of the present invention will now be described in detail with reference to the accompanying drawings.

Figure 1:
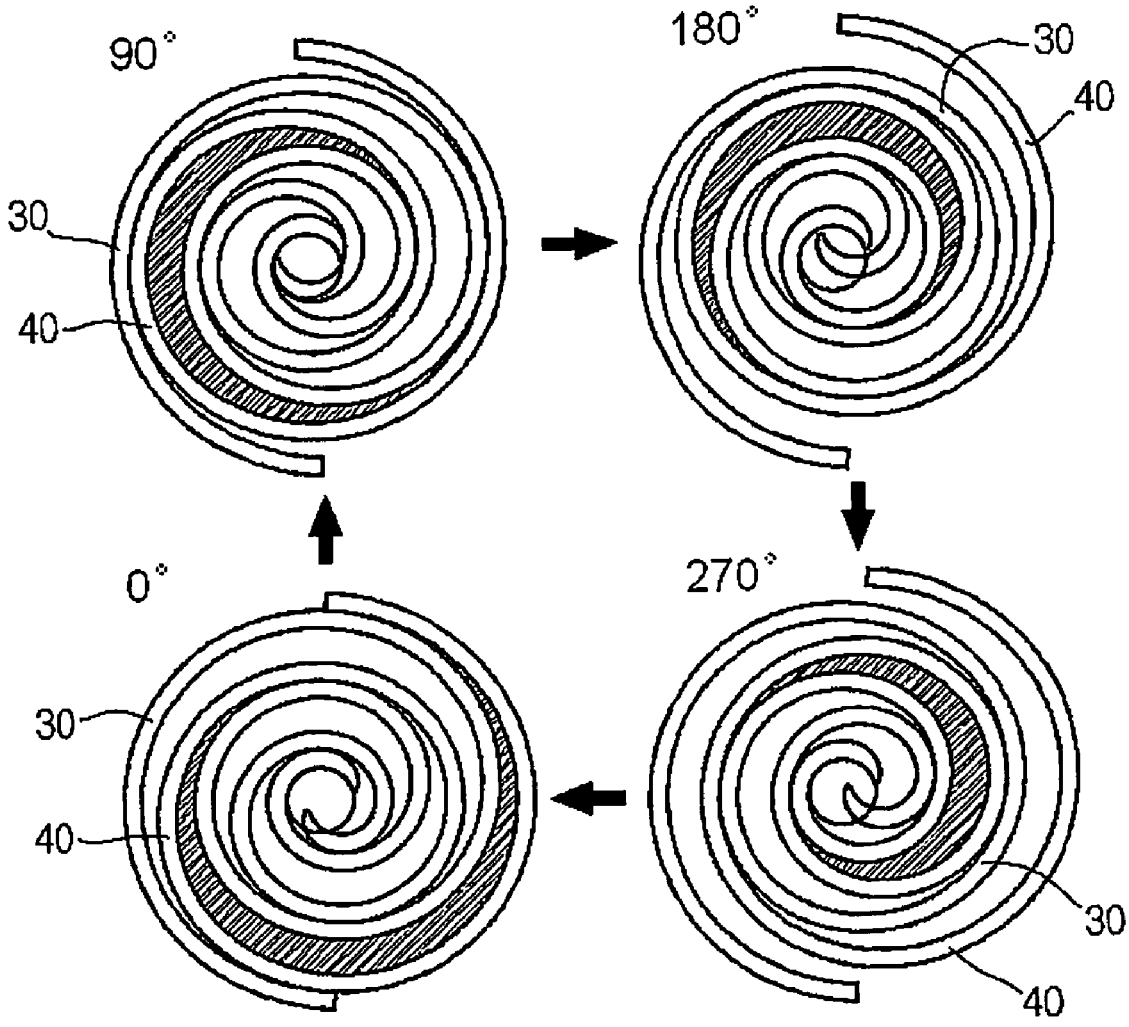
FIG. 1 is a schematic drawing showing the interaction between a stationary scroll member and a orbiting scroll member, and is used to describe an operation of a scroll-type compressor.
Figure 2:
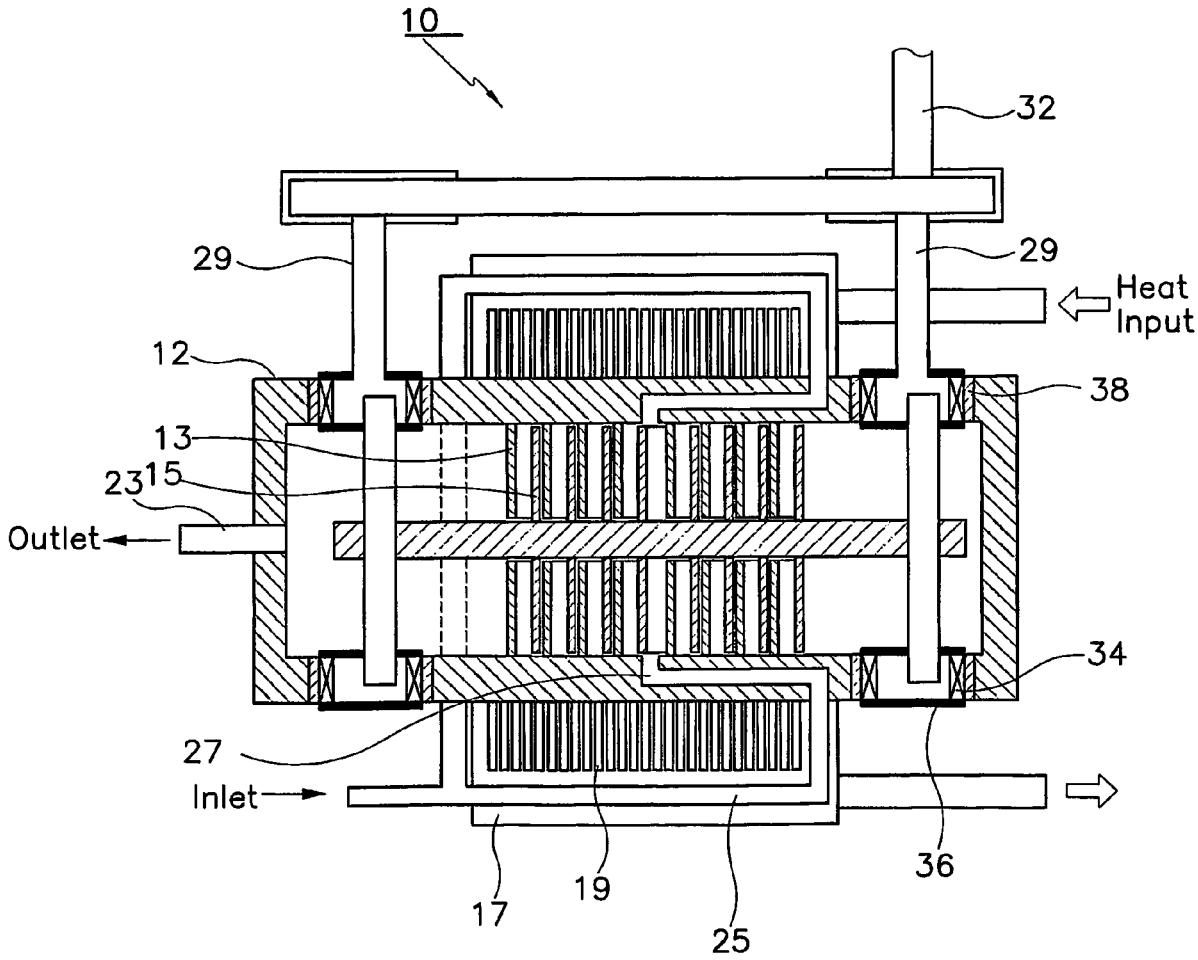
FIG. 2 is a sectional view of a scroll-type expander according to a preferred embodiment of the present invention.

Referring to FIG. 2, a scroll-type expander 10 according to a preferred embodiment of the present invention includes stationary scroll members 13 and orbiting scroll members 15 provided within a housing 12, and it performs expansion of an working fluid flowing into the scroll-type expander 10 then expels the same from the housing 12.

The housing 12 includes a heating surface to an outside; two inflow openings 27 to a center area that act as openings for the working fluid, the inflow openings 27 being provided at upper and lower areas; and an exhaust opening 23 that allows the exhaust of the working fluid to outside the housing 12.

The stationary scroll members 13 are fixed to an inner surface of the housing 12 and extend from the center area of the housing 12 outwardly in a spiral shape. A pair of the stationary scroll members 13 are provided in an opposing configuration. A center of the stationary scroll members 13 corresponds to the inflow openings 27 of the housing 12.

The orbiting scroll members 15 are meshed with stationary scroll members 13 within the housing 12, and they also extend from the center area of the housing 12 outwardly in a spiral shape. The orbiting scroll members 15 are orbiting along a predetermined orbiting radius to continuously expand working fluid entering the housing 12. A pair of the orbiting scroll members 15 is mounted between the pair of the opposing stationary scroll members 13, with one orbiting scroll member 15 being meshed with one stationary scroll member 13.

Heating chambers 17 are provided to an outer circumference of the housing 12. The heating chambers 17 supply heat to inside the housing 12 when working fluid is expanded by the motion of the orbiting scroll members 15.

Heat pipes (not shown) may be provided in the heating chambers 17 so that there is sufficient heat transfer and uniform temperature distribution. The heat pipes are able to transmit large amounts of heat by the low temperature difference as a result of latent heat.

Pre-heating pipes 25 are connected to the inflow openings 27 and extend into the heating chambers 17. The pre-heating pipes 25 pass through the heating chambers 17 so that the working fluid entering the heating chambers 17 may absorb heat.

Further, a plurality of heating pins 19 are formed to an external heating surface of the housing 12 that is located within the heating chambers 17. The heating pins 19 increase the heat transfer rate to the housing 12.

Drive shafts 29 are connected to the orbiting scroll members 15 to drive the same. Two of the drive shafts 29 are connected to both ends of the orbiting scroll members 15. A power transmission shaft 32 is connected to one of the drive shafts 29 to enable the transmission of power to outside the scroll-type expander 10. A bearing assembly 34 is mounted where the drive shafts 29 are connected to undergo rotation.

Further, a seal 36 is provided at each area of connection of the drive shafts 29. The seal 36 prevents leakage of lubrication oil. Also, an insulating material 38 is formed between the bearing assemblies 34 and the housing 12 to prevent overheating of the bearing assemblies 34.

Working fluid supplied through the pre-heating pipes 25 undergoes a primary heating process while passing through the pre-heating pipes 25, and is supplied to inside the housing 12 through the inflow openings 27. The working fluid is then slowly expanded while passing between the orbiting scroll members 15 and the stationary scroll members 13. During this process, the working fluid is re-heated by the effective supply of heat of the wide heating surface of the housing 12 and the scroll wraps such that a highly efficient expansion that approaches isothermal expansion is realized. The working fluid expanded in this manner is exhausted to outside the housing 12 through the exhaust opening 23.

When the temperature of the scroll-type expander 10 is lower than the temperature of the supplied operational fluid, the scroll-type expander 10 of the preferred embodiment of the present invention may also be used as a scroll-type expander of a refrigerator that absorbs heat in the scroll-type expander 10 driven by external power.

Figure 3:
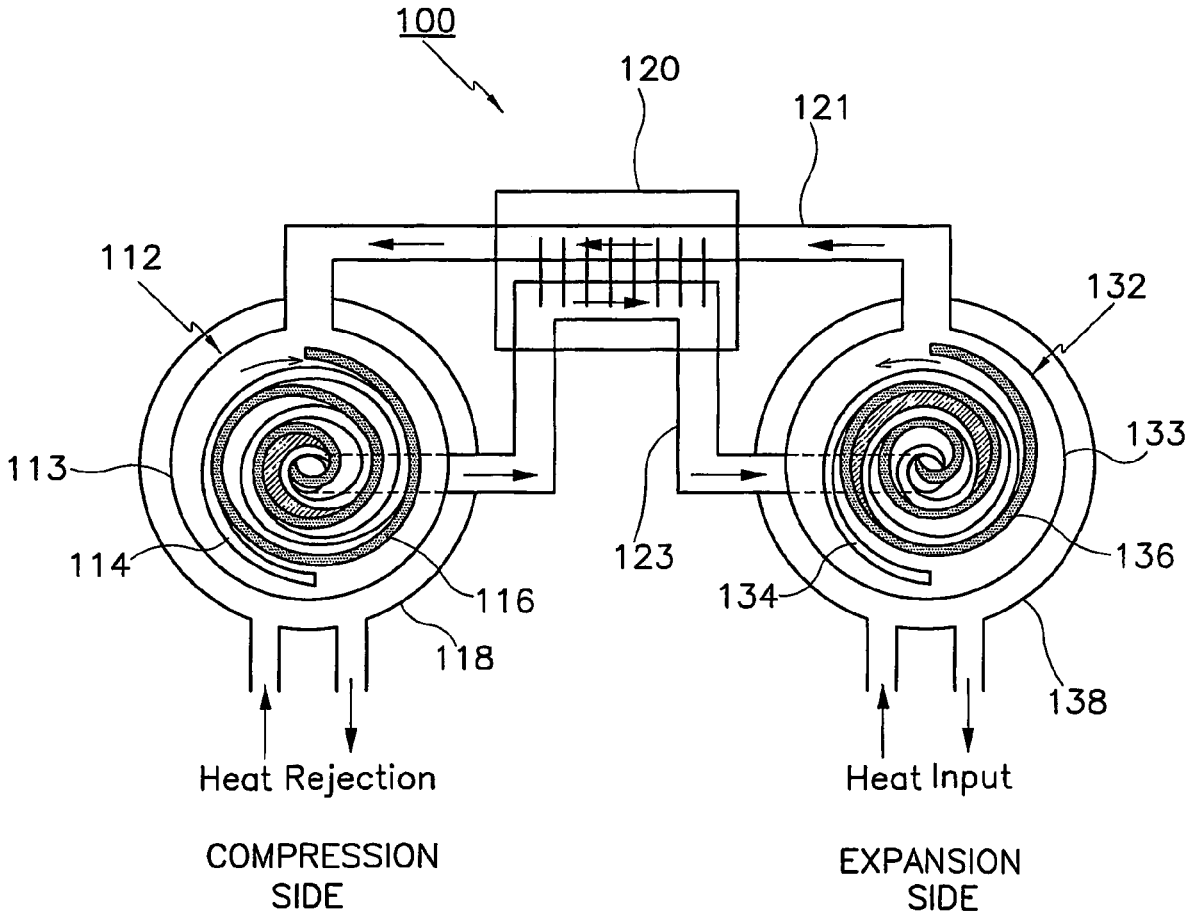
FIG. 3 is a schematic view of a scroll heat exchange system according to a first embodiment of the present invention.

With reference to FIG. 3, a basic structure of a scroll heat exchange system 100 according to a first preferred embodiment of the present invention includes a scroll-type compressor 112, a scroll-type expander 132, and a regenerator 120. The scroll-type compressor 112 and the scroll-type expander 132 are interconnected through a first connector 121 and a second connector 123.

The scroll-type compressor 112 includes a stationary scroll member 114 and a orbiting scroll member 116 provided within a housing 113, and acts to compress working fluid that enters the scroll-type compressor 112 and exhaust the compressed working fluid through a center area. The housing 113 includes one working fluid inflow opening at an outer area and one working fluid exhaust opening at the center area, and is otherwise sealed from the outside. The stationary scroll member 114 is fixed within the housing 113 and is extended from the center area of the housing 113 outwardly in a spiral shape. The orbiting scroll member 116 is meshed with the stationary scroll member 114 within the housing 113, and also extends from the center area of the housing 113 outwardly in a spiral shape. The orbiting scroll member 116 is orbiting along a predetermined orbiting radius in the space made with the stationary scroll member 114 to continuously compress working I fluid entering the housing 113.

A refrigerating section 118 is formed around an outer circumference of the housing 113 that surrounds the scroll-type compressor 112. The cooling section 118 allows for heat generated when working fluid is compressed to be expelled outwardly. To realize this, the housing 113 has a heat radiation surface to an outer area thereof.

The scroll-type expander 132 includes a stationary scroll member 134 and a orbiting scroll member 136 provided within a housing 133, and acts to expand working fluid that enters the scroll-type expander 132 and exhaust the expanded working fluid. The housing 133 includes one working fluid inflow opening at a center area and one working fluid exhaust opening at an outer area, and is otherwise sealed from the outside. The stationary scroll member 134 is fixed within the housing 133 and is extended from the center area of the housing 133 outwardly in a spiral shape. The orbiting scroll member 136 is meshed with the stationary scroll member 134 within the housing 133 and also extends from the center area of the housing 133 outwardly in a spiral shape. The orbiting scroll member 136 is orbiting along a predetermined orbiting radius in the space made with the stationary scroll member 134 to continuously expand working fluid entering the housing 133.

A heating section 138 is formed around an outer circumference of the housing 133 that surrounds the scroll-type expander 132. The heating section 138 allows heat to be supplied during expansion of working fluid, and to realize this, the housing 133 has a heating surface to an outer area thereof.

Each of the orbiting scroll members 116 and 136 of the scroll-type compressor 112 and the scroll-type expander 132, respectively, are connected to a driver (not shown) so that the orbiting scroll members 116 and 136 may be orbiting.

As described above, the scroll-type compressor 112 and the scroll-type expander 132 are interconnected through the first connector 121 and the second connector 123. In more detail, the first connector 121 interconnects the working fluid exhaust and inflow openings at the outer areas of the scroll-type compressor 112 and the scroll-type expander 132, while the second connector 123 interconnects the working fluid exhaust and inflow openings at the center areas of the scroll-type compressor 112 and the scroll-type expander 132.

Heat exchange is realized in the regenerator 120 by the first and second connectors 121 and 123 structured in this manner. The first and second connectors 121 and 123 pass through the regenerator 120 in a state adjacent to one another to realize heat exchange between the working fluid passing through the first and second connectors 121 and 123.

The working fluid is compressed in the scroll-type compressor 112 then exhausted through the exhaust opening at the center area of the scroll-type compressor 112, passed through the regenerator 120 via the second connector 123, then supplied through the inflow opening at the center area of the scroll-type expander 132. The working fluid then undergoes expansion in the scroll-type expander 132, is exhausted through the exhaust opening at the outer area of the scroll-type expander 132, passed through the regenerator 120 via the first connector 121, then is supplied through the inflow opening at the outer area of the scroll-type compressor 112. This process is repeated to realize circulation of the working fluid through the heat exchange system 100.

Figure 4:
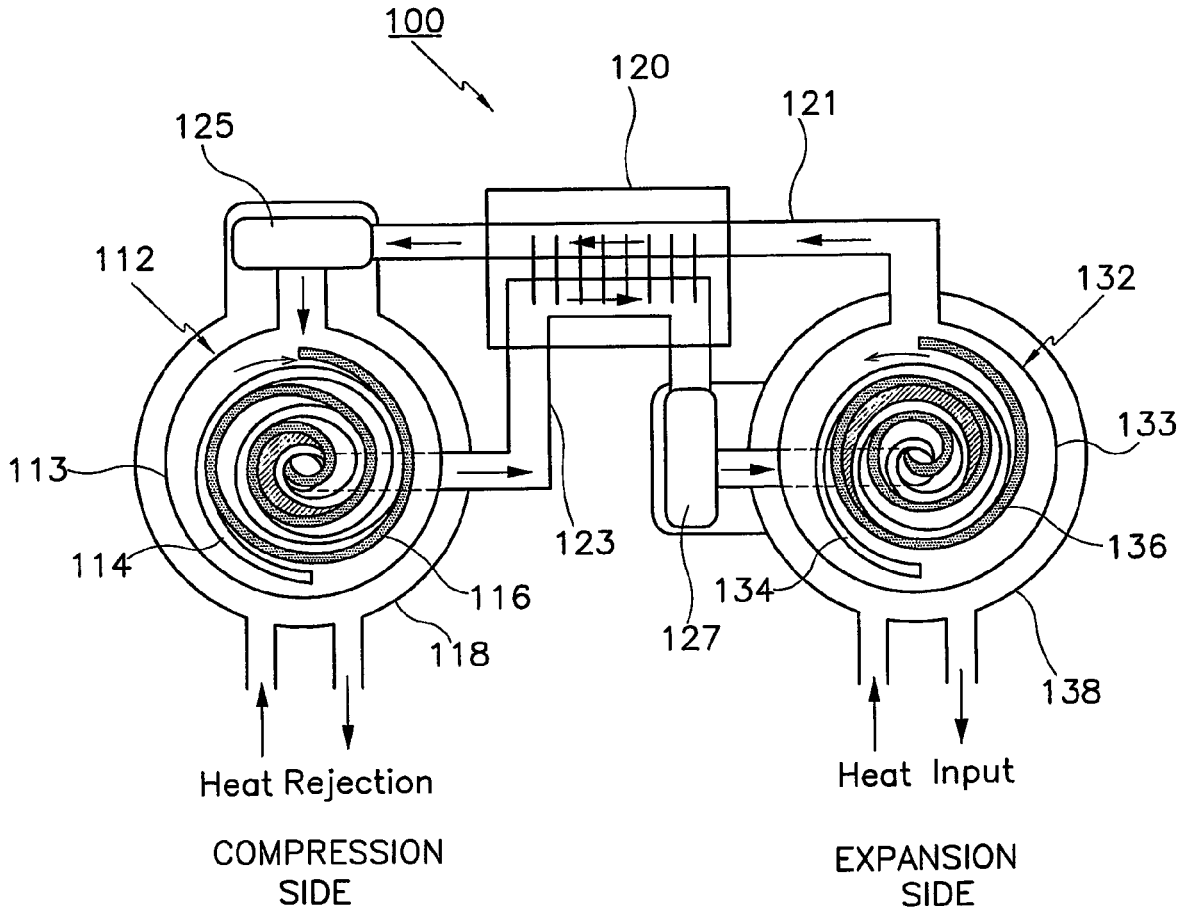
FIG. 4 is a schematic view of a scroll heat exchange system according to a first embodiment of the present invention with a cooler and a heater attached thereto.

With reference to FIG. 4, a cooler 125 and a heater 127 may be further included in the scroll heat exchange system 100 according to the first embodiment of the invention.

The cooler 125 is connected to the operational fluid inflow opening provided to the outer area of the scroll-type compressor 112, and acts to cool the working fluid that is supplied to the scroll-type compressor 112 after passing through the regenerator 120. The heater 127 is connected to the working fluid exhaust opening provided to the center area of the scroll-type expander 132, and acts to heat the working fluid that is supplied to the scroll-type expander 132 after passing through the regenerator 120.

When a temperature of the scroll-type expander 132 is higher than a temperature of the scroll-type compressor 112, the scroll heat exchange system 100 operates as an engine such that heat is received in the scroll-type expander 132 and heat is rejected from the scroll-type compressor 112 in the manner of a Stirling engine. Further, heat is transferred from the working fluid of after expansion to the working fluid of after compression, and power is output through a driver.

On the other hand, if the temperature of the scroll-type expander 132 is lower than the temperature of the scroll-type compressor 112, the scroll heat exchange system 100 operates as a refrigerator such that external power is received through the driver and heat is received from the scroll-type expander 132 and heat is output from the scroll-type compressor in the manner of a Stirling refrigerator. Also, heat is transferd from the working fluid of after compression to the working fluid of after expansion.

Figure 5:
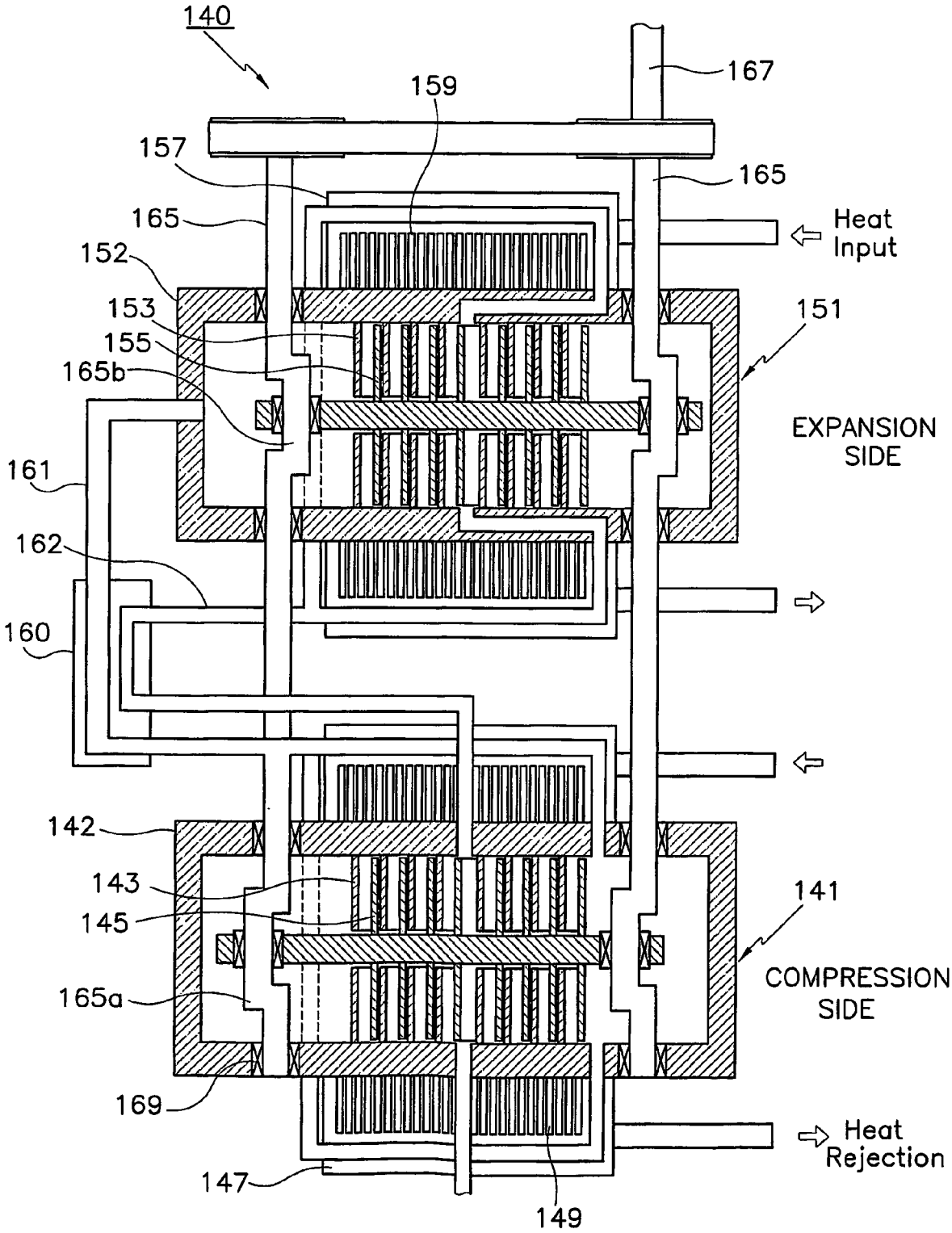
FIG. 5 is a sectional view of a scroll heat exchange system according to a second embodiment of the present invention.

FIG. 5 is a sectional view of a scroll heat exchange system according to a second embodiment of the present invention.

With reference to the drawing, a scroll heat exchange system 140 according to a second preferred embodiment of the present invention is basically the same in structure to the scroll heat exchange system 100 according to the first preferred embodiment of the present invention. However, a pair of stationary scroll members 143 and a pair of orbiting scroll members 145 are provided in a housing 142 of a scroll-type compressor 141, and a pair of stationary scroll members 153 and a pair of orbiting scroll members 155 are provided in a housing 152 of the scroll-type expander 151 such that an upsetting moment is not generated.

A plurality of cooling pins 149 are formed to an external surface of the housing 142 of the scroll-type compressor 141, and a plurality of heating pins 159 are formed to an external surface of the housing 152 of the scroll-type expander 151 such that cooling and heating are better performed.

The orbiting scroll members 145 and 155 of the scroll-type compressor 141 and the scroll-type expander 151, respectively, are each connected to two drive shafts 165 to drive the same. A first drive shaft section 165*a* connected to the orbiting scroll members 145 of the scroll-type compressor 141 and a second drive shaft section 165*b* connected to the orbiting scroll members 155 of the scroll-type expander 151 are 180° out of phase. Such a configuration is used to minimize unbalancing caused by rotational force.

The two drive shafts 165 are connected by a belt or chain to rotate in unison. Also, the drive shafts 165 transmit power to the outside through a power transmission shaft 167 that extends outwardly from the scroll heat exchange system 140. A bearing assembly 169 is mounted where the drive shafts 165 are connected to undergo rotation.

In the heat exchange system 140 according to the second preferred embodiment of the present invention, working fluid is additionally cooled by passing through the regenerator 160 and cooling chambers 147. Further, the working fluid flows into the scroll-type compressor 141 through the first connector 161 to be compressed by the motion of the orbiting scroll members 145. During compression, the working fluid is further cooled by the cooling pins 149 formed on the housing 142 in the area of the same corresponding to where the cooling chambers 147 are formed.

The working fluid compressed in this manner passes through the regenerator 160 through the second connector 162 to realize heat exchange with the high temperature working fluid passing through the first connector 161, thereby being heated. Next, this working fluid passes through heating chambers 157 to be further heated, then is supplied to inside the scroll-type expander 151 to be expanded while acting against the orbiting scroll members 155. During expansion, the working fluid is further heated by the heating pins 159 formed on the housing 152 in the area of the same corresponding to where the heating chambers 157 are formed.

The working fluid expanded in this manner again passes through the regenerator 160 via the first connector 161 to realize heat exchange with the low temperature working fluid passing through the second connector 162, thereby being cooled. Next, this working fluid is supplied to inside the scroll-type compressor 141 to complete the cycle.

The upper and lower cooling chambers 147 of the scroll-type compressor 141 are interconnected, and the upper and lower heating chambers 157 of the scroll-type expander 151 are interconnected. Further, the working fluids exhausted through upper and lower center areas of the scroll-type compressor 141 are combined for supply to the regenerator 160, and the working fluids supplied to the scroll-type expander 151 from the regenerator 160 are also combined.

Figure 6:
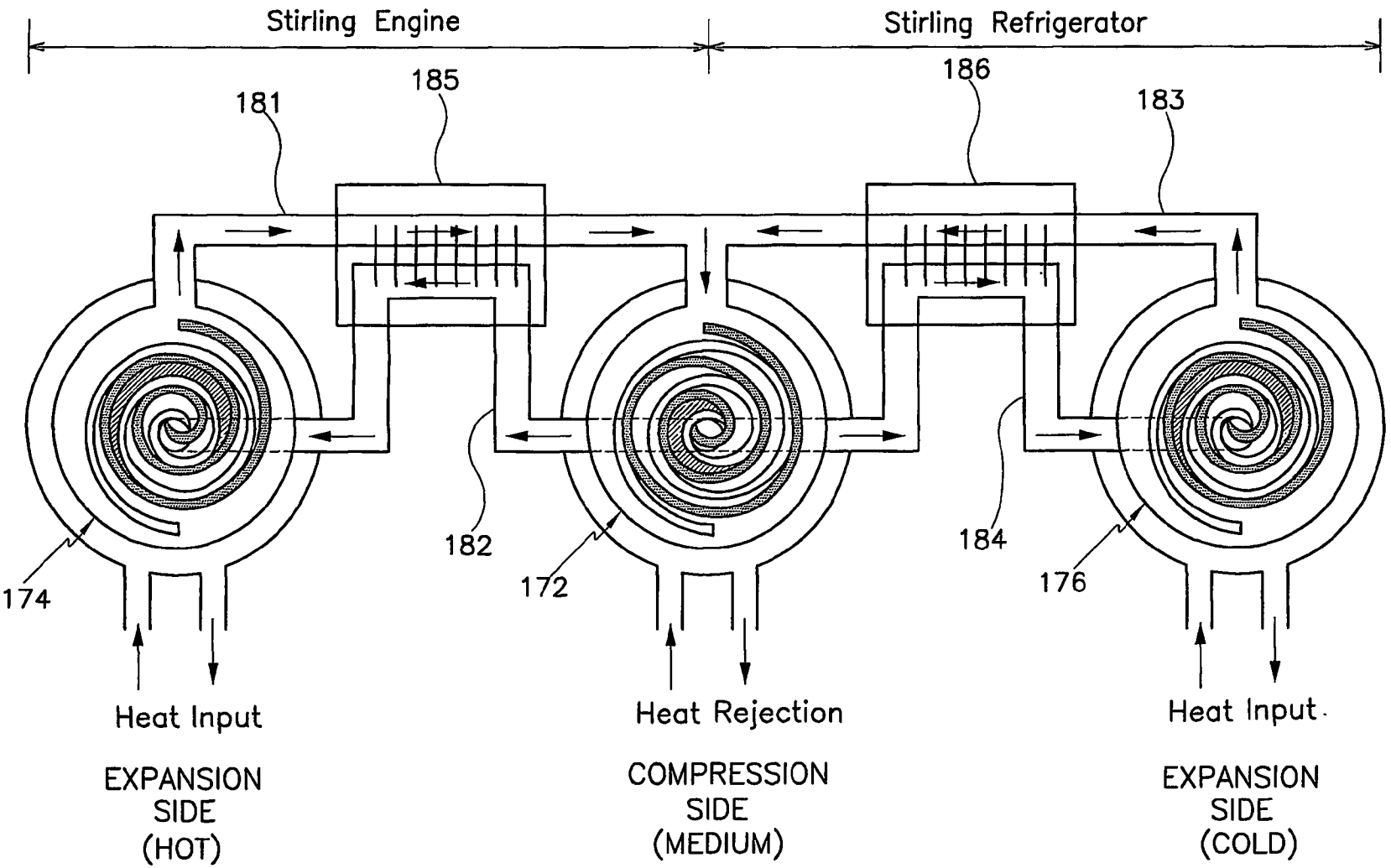
FIG. 6 is a schematic view of a scroll heat exchange system according to a third embodiment of the present invention.

FIG. 6 is a schematic view of a scroll heat exchange system according to a third embodiment of the present invention.

With reference to the drawing, in a heat exchange system according to a third embodiment of the present invention, a center scroll-type compressor 172 is provided to a middle area of the system. Also, a first scroll-type expander 174 of a higher temperature than the center scroll-type compressor 172 is connected to one side of the same, and a second scroll-type expander 176 of a lower temperature than the scroll-type compressor 172 is connected to another side of the same. The heat exchange system structured in this manner may be used as a Stirling refrigerator driven by Stirling engine.

That is, the combination of the high temperature first scroll-type expander 174 and the scroll-type compressor 172 operates as a Stirling engine, and the combination of the low temperature second scroll-type expander 176 and the scroll-type compressor 172 operates as a Stirling refrigerator.

Such a structure is made possible by the joint use of the first scroll-type expander 174 and the second scroll-type expander 176 both having inflow and exhaust openings for working fluid of the scroll-type compressor 172. Accordingly, working fluid is compressed in the scroll-type compressor 172 then exhausted through an exhaust opening of a center area. Part of the working fluid passes through a second connector 182 then through a first regenerator 185, after which the working fluid flows into a center area inflow opening of the first scroll-type expander 174 to be expanded therein. The working fluid is then exhausted through an exhaust opening of an outer circumference, passed through a first connector 181 and through the first regenerator 185, and flowed into an inflow opening of an outer circumference of the scroll-type compressor 172 to thereby realize circulation through the system. The other part of the working fluid passes through a fourth connector 184 and through a second regenerator 186 to flow into an inflow opening of a center area of the second scroll-type expander 176 to be expanded therein. The working fluid is then exhausted through an exhaust opening of an outer circumference, passed through a third connector 183 and through a second regenerator 186, and flowed into an inflow opening of an outer circumference of the scroll-type compressor 172 to thereby realize circulation through the system.

By jointly using the scroll-type compressor for the Stirling engine and Stirling refrigerator, a compact structure is realized for the Stirling refrigerator driven by Stirling engine. Also, since a power remaining after refrigerator driving may be used to generate electric power using a generator, a system that realizes both air conditioning and electric power generation may be realized.

Figure 7:
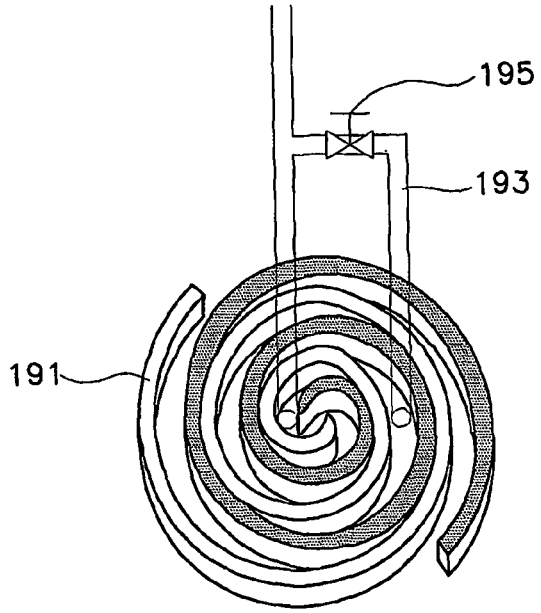
FIG. 7 is a schematic view of a scroll assembly connected to a bypass line according to a preferred embodiment of the present invention.
Figure 8:
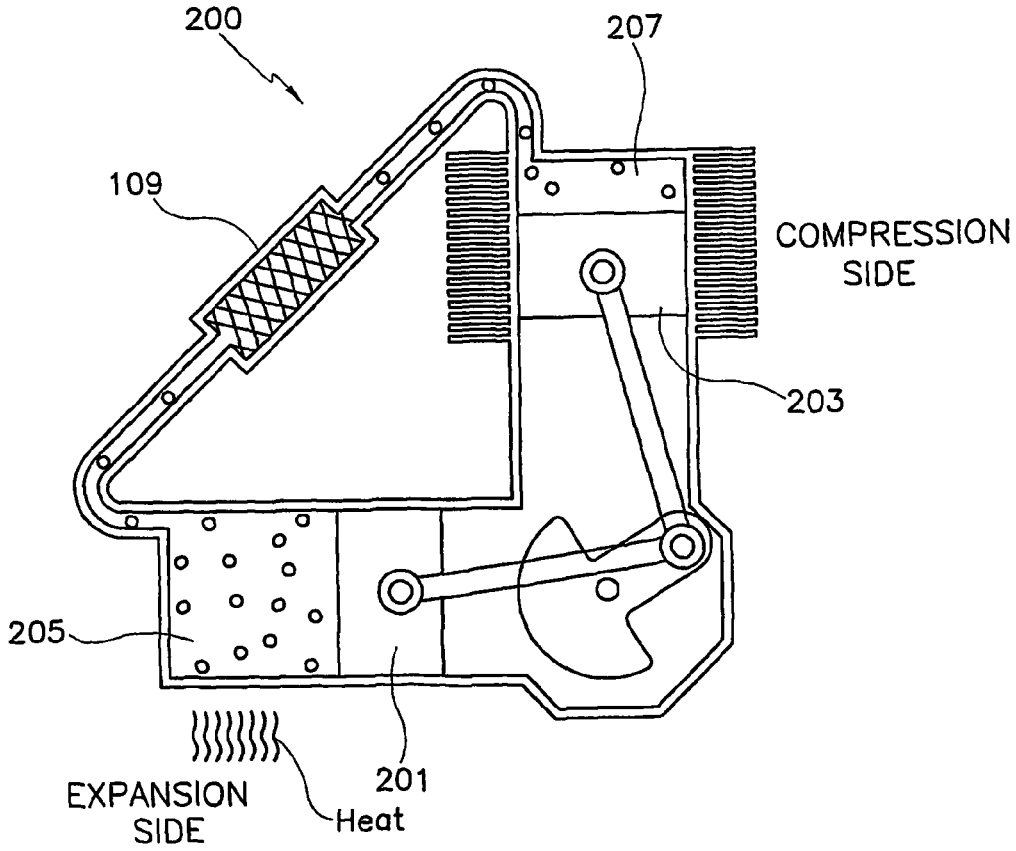
FIG. 8 is a schematic view of a conventional reciprocating Stirling engine.
Figure 9:
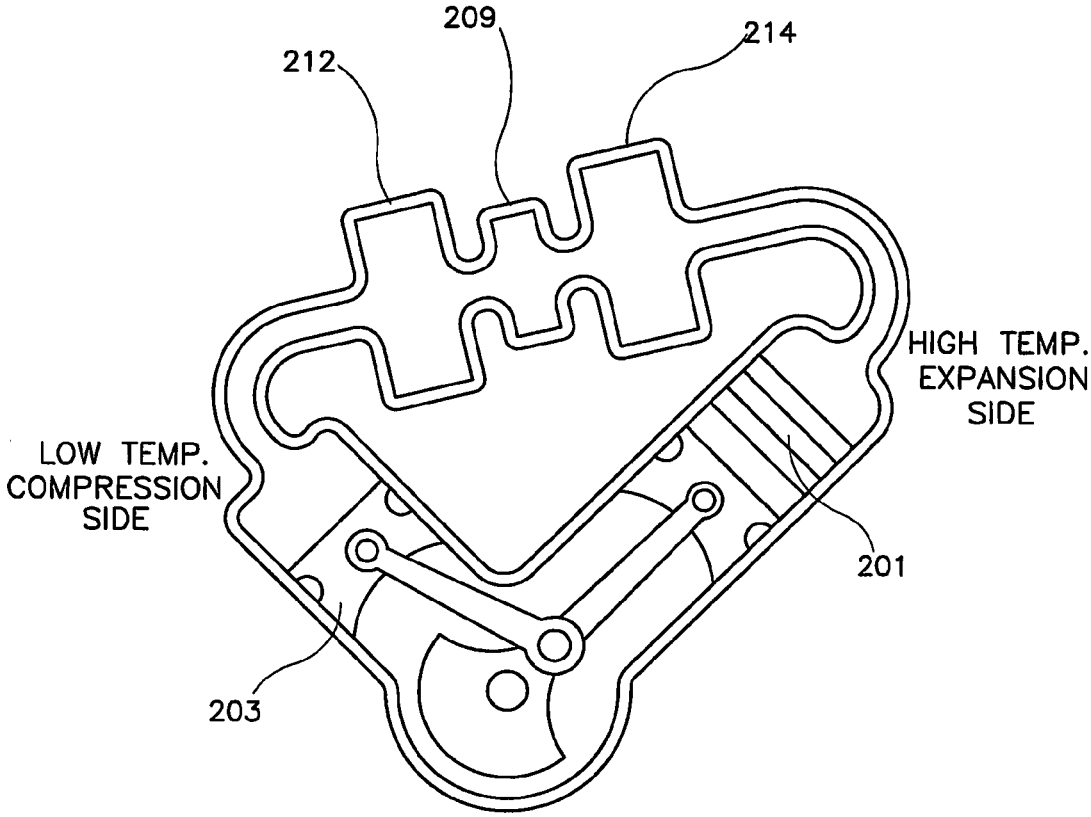
FIG. 9 a schematic view of a conventional reciprocal Stirling engine with a heater and a cooler attached thereto.
Figure 10:
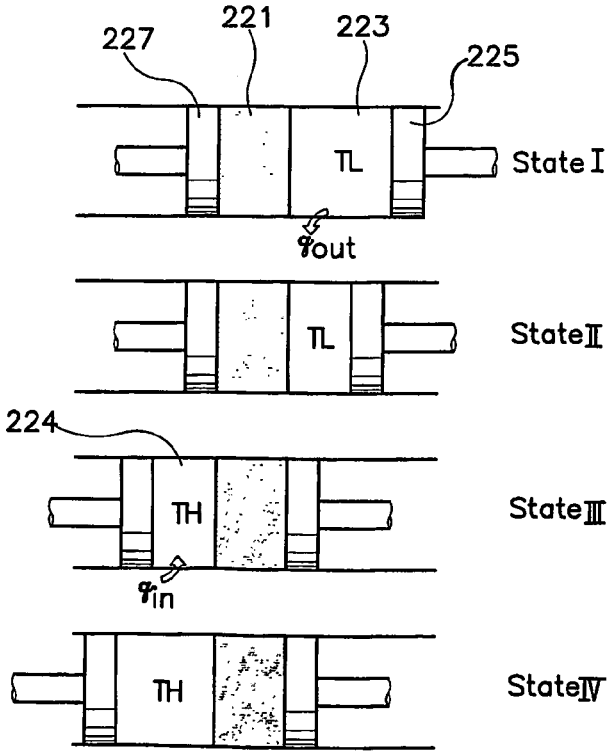
FIG. 10 is a schematic view used to describe the sequential processes in an ideal Stirling cycle.
Figure 11:
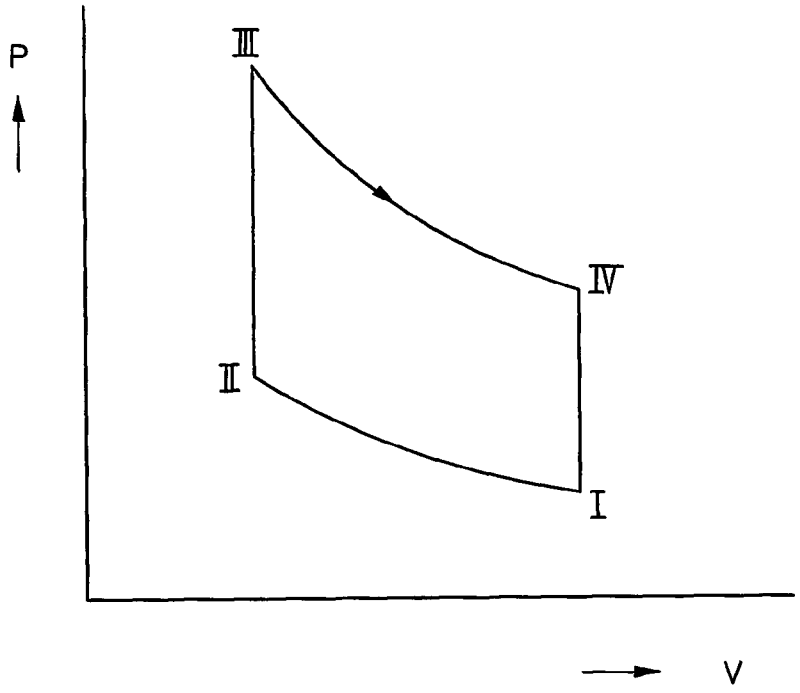
FIG. 11 is a P–V diagram of an ideal Stirling cycle.
Figure 12:
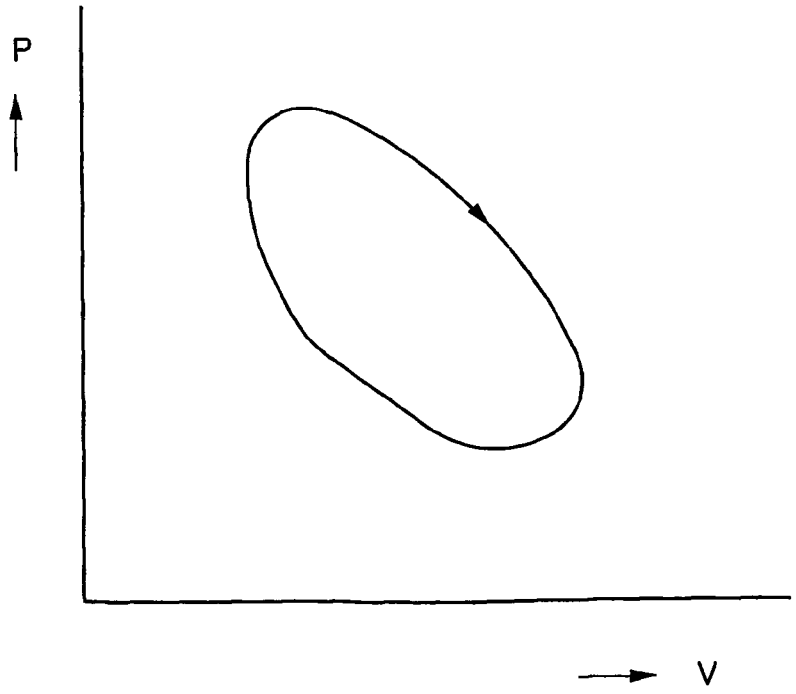
FIG. 12 is a P–V diagram of an actual Stirling cycle.
Figure 13:
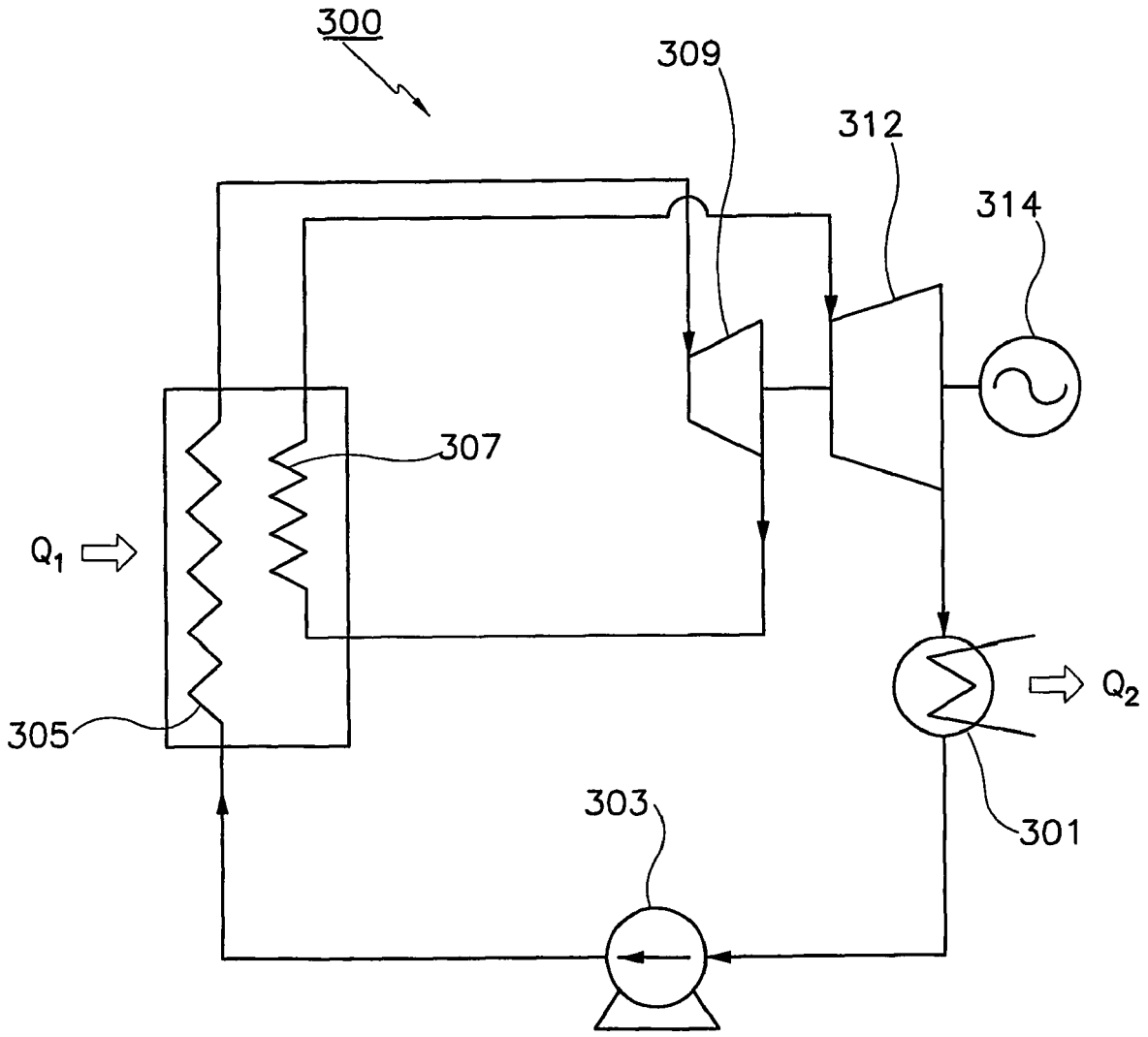
FIG. 13 is a schematic view of a conventional Rankine system that uses a re-heating cycle.

FIG. 7 is a schematic view of a scroll assembly connected to a bypass line according to a preferred embodiment of the present invention.

In the conventional control method for a reciprocating Stirling apparatus, although there are internal working gas pressure changes, dead volume control, and compression ratio changes as a result of stroke control, the entire apparatus is complicated and high in cost. With reference to FIG. 7, in a control method for a Stirling cycle apparatus using a scroll apparatus, compression capacity is controlled by controlling a bypass line 193 at a center compression area of a stationary scroll member 191 of a scroll-type compressor. As a result, compression amounts are easily controlled. Engine control is therefore quickly and effectively realized.

The center compression area is positioned a predetermined distance from a center area of the scroll-type compressor. Further, the bypass line 193 is formed communicating a connector connected to the center area of the scroll-type compressor and the center compression area. A control valve 195 is provided on the bypass line 193 to control the amount of fluid that is bypassed.

Figure 14:
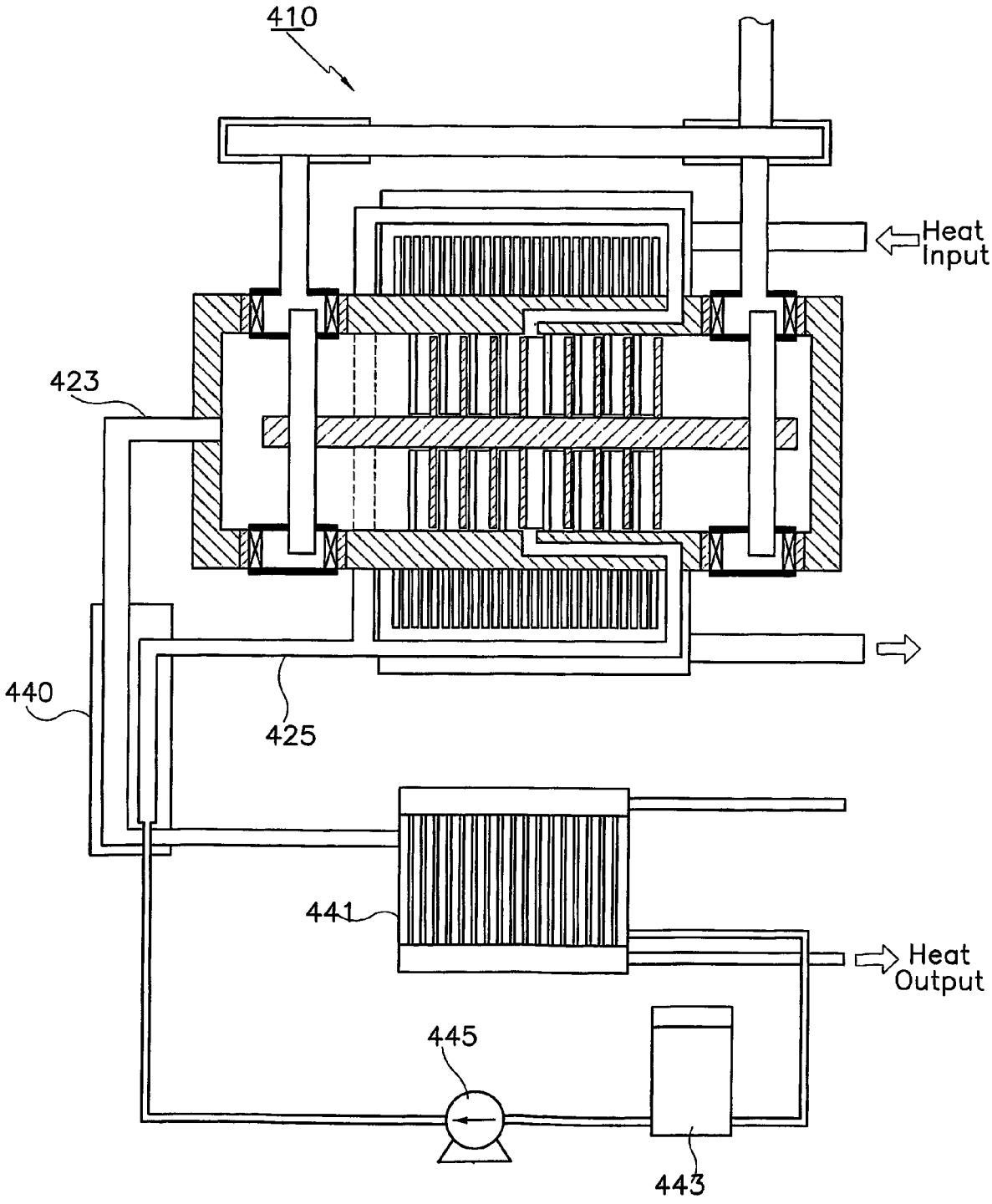
FIG. 14 is a sectional view of a steam engine including a scroll-type expander according to a preferred embodiment of the present invention.

FIG. 14 is a sectional view of a steam engine including a scroll-type expander according to a preferred embodiment of the present invention.

With reference to the drawing, in addition to a scroll-type expander 410, the steam engine includes a heat exchanger 440, a condenser 441, a storage tank 443, and a pump 445.

An exhaust opening 423 of the scroll-type expander 410 is connected to the heat exchanger 440 such that high temperature working fluid expanded in and exhausted from the scroll-type expander 410 passes through the heat exchanger 440. The heat exchanger 440 is also connected to the condenser 441.

Working fluid passed through the heat exchanger 440 flows into the condenser 441 to be condensed therein. The condenser 441 is connected also to the storage tank 443 such that the working fluid passed through the condenser 441 is temporarily stored in the storage tank 443. The storage tank 443 is connected to a pump 445 and acts as a gas-water separator to increase a compression efficiency of the pump 445 and to replenish the working fluid.

The pump 445 acts to pressurize the working fluid supplied from the storage tank 443. The pump 445 is also connected to the heat exchanger 440.

The working fluid pressurized in the pump 445 is heated by receiving heat from the high temperature working fluid exhausted from the scroll-type expander 410 while passing through the heat exchanger 440. The working fluid heated in this manner is supplied to the scroll-type expander 410 through a pre-heat pipe 425.

The steam engine having the scroll-type expander structured as in the above operates identically to the steam turbine Rankine system that uses a regeneration cycle and an infinite stages re-heating cycle.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A scroll-type expander, comprising:

a sealed housing having a heating surface to an outside area, and including at least one of each of an inflow opening and an exhaust opening at both a center area and a circumferential area;

at least a stationary scroll member fixed within the housing and extending from the center area of the housing outwardly in a spiral shape;

at least an orbiting scroll member meshed with the stationary scroll member within the housing and extending from the center area of the housing outwardly in a spiral shape, the orbiting scroll member being orbiting along a predetermined orbiting radius to continuously expand working fluid entering the housing;

heating chamber provided to an outer circumference of the housing and which supply heat when working fluid is expanded by the motion of the orbiting scroll member; drive shafts connected to the orbiting scroll member to drive the orbiting scroll member; and a pre-heating pipe connected to the working fluid inflow opening of the center area of the housing and extending into the heating chambers to pass through the heating chambers so that the working fluid entering the heating chambers may absorb heat.

2. The scroll-type expander of claim 1, further comprising heat pipe connected to the heating chambers and able to transmit large amounts of heat by a low temperature difference as a result of latent heat.

3. The scroll-type expander of claim 1, further comprising a plurality of heating pins formed to the external heating surface of the housing that is located within the heating chambers.

4. The scroll-type expander of claim 1, further comprising a power transmission shaft connected to an outside of one of the drive shafts to enable the transmission of power to outside the scroll-type expander.

5. The scroll-type expander of claim 1, wherein the orbiting scroll member is connected to at least two of the drive shafts to be driven by the drive shafts.

6. The scroll-type expander of claim 1, wherein a pair of the stationary scroll members are provided opposing one another in the housing, and a pair of the orbiting scroll members are provided meshed with the stationary scroll members.

7. The scroll-type expander of claim 1, wherein a shaft seal is provided at each area of connection of the drive shafts to the housing, the seal providing a lubricated seal.

8. The scroll-type expander of claim 1, wherein a bearing assembly is mounted where the drive shafts are connected to the housing, and an insulating material is provided where the drive shafts are connected to the housing to prevent overheating of the bearing assemblies and to prevent heat from escaping from inside the housing.

9. A scroll heat exchange system, comprising: a scroll-type compressor including a sealed housing having a heat radiation surface and having at least one of each of an working fluid inflow opening and an exhaust opening at both a center area and a circumferential area, a stationary scroll member fixed within the housing and extending from the center area of the housing outwardly in a spiral shape, and a orbiting scroll member meshed with the stationary scroll member within the housing and extending from the center area of the housing outwardly in a spiral shape, the orbiting scroll members being orbiting along a predetermined orbiting radius to continuously compress working fluid entering the housing;

a scroll-type expander including a sealed housing having a heating surface and having at least one of each of an working fluid inflow opening and an exhaust opening at both a center area and a circumferential area, a stationary scroll member fixed within the housing and extending from the center area of the housing outwardly in a spiral shape, and a orbiting scroll member meshed with the stationary scroll member within the housing and extending from the center area of the housing outwardly in a spiral shape, the orbiting scroll members being orbiting along a predetermined orbiting radius to continuously expand working fluid entering the housing;

a driver connected to each of the orbiting scroll members of the scroll-type compressor and the scroll-type expander to drive the orbiting scroll members;

a first connector interconnecting the working fluid exhaust and inflow openings at the outer areas of the scroll-type compressor and the scroll-type expander;

a second connector interconnecting the working fluid exhaust and inflow openings at the center areas of the scroll-type compressor and the scroll-type expander;

a regenerator through which the first and second connectors pass in a state adjacent to one another to realize heat exchange between the working fluid passing through the first and second connectors;

and working fluid compressed in the scroll-type compressor, exhausted through the exhaust opening at the center area of the scroll-type compressor, passed through the regenerator via the second connector, then supplied through the inflow opening at the center area of the scroll-type expander, after which the working fluid undergoes expansion in the scroll-type expander, is exhausted through the exhaust opening at the outer area of the scroll-type expander, passed through the regenerator via the first connector, and supplied through the inflow opening at the outer area of the scroll-type compressor to thereby realize circulation of the working fluid through the heat exchange system.

10. The scroll heat exchange system of claim 9, further comprising a cooling section formed around an outer circumference of the housing that surrounds the scroll-type compressor such that heat generated when working fluid is compressed is expelled outwardly, and a heating section formed around an outer circumference of the housing that surrounds the scroll-type expander such that heat is supplied during expansion of working fluid.

11. The scroll heat exchange system of claim 9, further comprising a cooling connected to the working fluid inflow opening provided to the outer area of the scroll-type compressor and acting to cool the working fluid that is supplied to the scroll-type compressor after passing through the regenerator, and a heater connected to the working fluid exhaust opening provided to the center area of the scroll-type expander and acting to heat the working fluid that is supplied to the scroll-type expander after passing through the regenerator.

12. The scroll heat exchange system of claim 9, further comprising a plurality of heat transfer pins that are formed to outer surfaces of the housing of the scroll-type compressor and the housing of the scroll-type expander, the heat transfer pins enabling easier heat absorption and heat rejection.

13. The scroll heat exchange system of claim 9, further comprising a bypass line communicating an area between a center compression area of a predetermined distance from the center area of the housing and the connector connected to the working fluid exhaust opening of the center area, and further comprising a control valve mounted on the bypass line to control the amount of fluid that is bypassed to vary compression amounts.

14. The scroll heat exchange system of claim 9, wherein the system operates as an engine when a heat of a temperature higher than a temperature of the scroll-type compressor is supplied to the scroll-type expander, and power is output from the drivers connected to the scroll-type expander and the scroll-type compressor.

15. The scroll heat exchange system of claim 9, wherein the system operates as a refrigerator when power is input to the drivers connected to the scroll-type expander and the scroll-type compressor, and a heat of a temperature lower than a temperature of the scroll-type compressor is absorbed in the scroll-type expander.

16. The scroll heat exchange system of claim 9, wherein the orbiting scroll members of the scroll-type compressor and the scroll-type expander are each connected to two drive shafts to be driven by the drive shafts.

17. The scroll heat exchange system of claim 16, wherein the drive shafts connected to the orbiting scroll members of the scroll-type compressor maintain a phase difference of 180° with the drive shafts connected to the orbiting scroll members of the scroll-type expander.

18. A scroll heat exchange system, comprising:

a first scroll-type expander including a sealed housing having a heating surface and having at least one of each of a working fluid inflow opening and an exhaust opening at both a center area and a circumferential area, a stationary scroll member fixed within the housing and extending from the center area of the housing outwardly in a spiral shape, and an orbiting scroll member meshed with the stationary scroll member within the housing and extending from the center area of the housing outwardly in a spiral shape, the orbiting scroll members being orbiting along a predetermined orbiting radius to continuously expand working fluid entering the housing;

a scroll-type compressor including a sealed housing having a heat radiation surface and having at least one of each of the working fluid inflow opening and an exhaust opening at both a center area and a circumferential area, a stationary scroll member fixed within the housing and extending from the center area of the housing outwardly in a spiral shape, and an orbiting scroll member meshed with the stationary scroll member within the housing and extending from the center area of the housing outwardly in a spiral shape, the orbiting scroll members being orbiting along a predetermined orbiting radius to continuously compress working fluid entering the housing;

a second scroll-type expander including a sealed housing having a heating surface and having at least one of each of a working fluid inflow opening and an exhaust opening at both a center area and a circumferential area, a stationary scroll member fixed within the housing and extending from the center area of the housing outwardly in a spiral shape, and an orbiting scroll member meshed with the stationary scroll member within the housing and extending from the center area of the housing outwardly in a spiral shape, the orbiting scroll members being orbiting along a predetermined orbiting radius to continuously expand working fluid entering the housing;

a driver connected to each of the orbiting scroll members of the scroll-type compressor and the scroll-type expanders to drive the orbiting scroll members;

a first connector interconnecting the working fluid exhaust and inflow openings at the outer areas of the scroll-type compressor and the first scroll-type expander;

a second connector interconnecting the working fluid exhaust and inflow openings at the center areas of the scroll-type compressor and the second scroll-type expander;

a first regenerator through which the first and second connectors pass in a state adjacent to one another to realize heat exchange between the working fluid passing through the first and second connectors;

a third connector interconnecting the working fluid exhaust and inflow openings at the outer areas of the scroll-type compressor and the second scroll-type expander;

a fourth connector interconnecting the working fluid exhaust and inflow openings at the center areas of the scroll-type compressor and the second scroll-type expander;

a second regenerator through which the third and fourth connectors pass in a state adjacent to one another to realize heat exchange between the working fluid passing through the third and fourth connectors; and working fluid compressed in the scroll-type compressor, exhausted through the exhaust opening at the center area of the scroll-type compressor, then part of the working fluid is passed through the first regenerator via the second connector, then supplied through the inflow opening at the center area of the first scroll-type expander, after which the working fluid undergoes expansion in the first scroll-type expander, is exhausted through the exhaust opening at the outer area of the scroll-type expander, passed through the first regenerator via the first connector, and supplied through the inflow opening at the outer area of the scroll-type compressor, and the remaining part of the working fluid is passed through the second regenerator via the fourth connector, then supplied through the inflow opening at the center area of the second scroll-type expander, after which the working fluid undergoes expansion in the second scroll-type expander, is exhausted through the exhaust opening at the outer area of the second scroll-type expander, passed through the second regenerator via the third connector, and supplied through the inflow opening at the outer area of the scroll-type compressor to thereby realize circulation of the operational fluid through the heat exchange system, wherein the first scroll-type expander and the scroll-type compressor may operate as an engine, and the second scroll-type expander and the scroll-type compressor may operate as a refrigerator.

19. A steam engine, comprising:

a scroll-type expander including a sealed housing having a heating surface and having at least one of each of an working fluid inflow opening and an exhaust opening at both a center area and a circumferential area, a stationary scroll member fixed within the housing and extending from the center area of the housing outwardly in a spiral shape, an orbiting scroll member meshed with the stationary scroll member within the housing and extending from the center area of the housing outwardly in a spiral shape, the orbiting scroll members being orbiting along a predetermined orbiting radius to continuously expand working fluid entering the housing, heating chambers provided to an outer circumference of the housing and which supply heat when working fluid is expanded by the motion of the orbiting scroll members, and drive shafts connected to the orbiting scroll members to drive the scroll members;

a heat exchanger through which high temperature working fluid expanded in the scroll-type expander and exhausted from the scroll-type expander passes;

a condenser for condensing the working fluid passing through the heat exchanger;

a storage tank for storing the working fluid passing through the condenser; and a pump for pressurizing the working fluid passing through the storage tank, wherein the working fluid pressurized in the pump is circulated by again passing through the heat exchanger to receive heat from high temperature working fluid, to be heated.

* * * * *